US006029559A

United States Patent [19]

Barthalow et al.

[11] Patent Number: 6,029,559

[45] Date of Patent: Feb. 29, 2000

[54] TELESCOPING SYSTEM WITH MULTIPLE SINGLE-STAGE TELESCOPIC CYLINDERS

[75] Inventors: Henry D. Barthalow, Greencastle; Claude R. Zimmerman, Mercersburg, both of Pa.

[73] Assignee: Grove U.S. L.L.C., Shady Grove, Pa.

[21] Appl. No.: 09/055,299

[22] Filed: Apr. 6, 1998

[51] Int. Cl.[7] ..... F15B 11/18

[52] U.S. Cl. ..... 91/167 R; 91/530; 91/520

[58] Field of Search ..... 91/167 R, 176, 91/520, 530, 531

[56] References Cited

U.S. PATENT DOCUMENTS

| | | | |
|---|---|---|---|
| 2,517,153 | 8/1950 | Wood . | |
| 3,128,674 | 4/1964 | Ganchar et al. . | |
| 3,373,572 | 3/1968 | Kemper . | |
| 3,483,798 | 12/1969 | Parrett et al. . | |
| 3,603,207 | 9/1971 | Parrett | 91/167 R |
| 3,610,100 | 10/1971 | Hoffman | 91/167 R |
| 3,696,712 | 10/1972 | Sung . | |
| 4,011,699 | 3/1977 | Mickelson | 52/115 |
| 4,125,974 | 11/1978 | Kay et al. | 91/530 X |
| 4,691,617 | 9/1987 | Purkott . | |
| 4,726,281 | 2/1988 | De Filippi . | |
| 4,733,598 | 3/1988 | Innes et al. | 91/168 |
| 4,741,246 | 5/1988 | Padarev . | |
| 4,791,854 | 12/1988 | Banicevic . | |
| 5,111,733 | 5/1992 | Baraniak | 91/167 R |
| 5,247,872 | 9/1993 | Hoshi . | |
| 5,249,502 | 10/1993 | Radocaj | 91/176 R X |
| 5,263,402 | 11/1993 | Gottlieb . | |
| 5,305,605 | 4/1994 | Cella . | |
| 5,322,004 | 6/1994 | Sims . | |
| 5,341,725 | 8/1994 | Dick . | |
| 5,375,348 | 12/1994 | Kishi . | |
| 5,377,432 | 1/1995 | Kishi . | |

FOREIGN PATENT DOCUMENTS

| | | |
|---|---|---|
| 0446115A1 | 9/1991 | European Pat. Off. . |
| 773183A2 | 5/1997 | European Pat. Off. . |
| 1934739 | 1/1971 | Germany . |
| 3324270A1 | 1/1985 | Germany . |
| 3622424A1 | 1/1988 | Germany . |
| 69102455T2 | 11/1994 | Germany . |
| 29616034U1 | 2/1997 | Germany . |

*Primary Examiner*—John E. Ryznic

*Attorney, Agent, or Firm*—Birch, Stewart, Kolasch & Birch, LLP

[57] ABSTRACT

The telescoping system includes a first fluid motor and a second fluid motor. The first fluid motor includes a first extension chamber and a first retraction chamber, and the second fluid motor includes a second extension chamber and a second retraction chamber. A hydraulic control system in the telescoping system controls the supply of hydraulic fluid to the first fluid motor and between the first fluid motor and the second fluid motor such that the first and second fluid motors operate independently.

14 Claims, 1 Drawing Sheet

TELESCOPING SYSTEM WITH MULTIPLE SINGLE-STAGE TELESCOPIC CYLINDERS

BACKGROUND OF THE INVENTION

1. Field of the Invention

The present invention relates to a telescoping system for selectively extending and retracting telescopic sections of a multi-section telescoping structure with respect to one another; and more particularly, to a telescoping system with multiple single-stage telescopic cylinders.

2. Description of Related Art

Many prior art telescoping systems include multiple single-stage telescopic cylinders or a single multi-stage telescopic cylinder for extending and retracting multi-section telescopic structures such as multi-section booms. A multi-stage telescopic cylinder includes a plurality of cylinders and pistons arranged in a telescopic manner, one within the other. In a telescoping system which includes multiple single-stage telescopic cylinders, the telescopic cylinders are hydraulically connected in series. U.S. Pat. No. 4,733,598 to Innes discloses such a telescoping system.

Unfortunately, telescoping systems such as Innes do not allow independent control over retraction and extension of each single-stage telescopic cylinder. Instead, the extension and retraction of the telescoping system is predetermined. Namely, the order in which the single-stage telescopic cylinders extend and retract is predetermined. Furthermore, each telescopic cylinder in the system fully retracts or extends. Accordingly, systems such as Innes are not flexible, and each time a user wants to change, for example, the order in which the telescopic cylinders extend and retract, a different telescoping system is required.

SUMMARY OF THE INVENTION

It is an object of the present invention to provide a telescoping system including multiple single-stage telescopic cylinders which overcomes the problems and disadvantages discussed above with respect to the related art.

Another object of the present invention is to provide a telescoping system including multiple single-stage telescopic cylinders which permits independent control over retraction and extension of each single-stage telescopic cylinder.

These and other objects are achieved by providing a telescoping system, comprising: a first tele cylinder including a first cylinder, a first rod having a first and second end, a first piston head connected to said first end of said first rod and disposed in said second cylinder, said second end of said first rod including first, second and third ports; said first rod, said first piston head and said first cylinder defining a first chamber; said first cylinder and said first piston head defining a second chamber; said first rod and said first piston head including a first passageway communicating said first port and said first chamber and a second passageway communicating said third port and said second chamber; said first cylinder and said first rod including a third passageway communicating with said second port; said first cylinder including a fourth passageway communicating with said first chamber; a second tele cylinder including a second cylinder, a second rod having a third and fourth end, a second piston head connected to said third end of said second rod and disposed in said second cylinder, said fourth end of said second rod including a fourth and fifth port; a first line connecting said fourth port and said third passageway; a second line connecting said fifth port and said fourth passageway said second rod, said second piston head and said second cylinder defining a third chamber; said second cylinder and said second piston head defining a fourth chamber; said second rod including a fifth passageway communicating said third chamber and said fifth port; and said second rod and said second piston head including a sixth passageway communicating said fourth port and said fourth chamber.

These and other objects are also achieved by providing a telescoping system, comprising: a first fluid motor having a first extension chamber and a first retraction chamber; a second fluid motor having a second extension chamber and a second retraction chamber; means for providing fluid communication between said first fluid motor and said second fluid motor; and wherein said first fluid motor includes a first extension supply port in fluid communication with said first extension chamber, a second extension port in fluid communication with said second extension chamber via said providing means, and a retraction supply port in fluid communication with said first retraction chamber and in fluid communication with said second retraction chamber via said providing means.

These and other objects are further achieved by providing a telescoping system, comprising: a first fluid motor having a first extension chamber and a first retraction chamber; a second fluid motor having a second extension chamber and a second retraction chamber; supply means for controlling supply of hydraulic fluid to said first fluid motor and between said first fluid motor and said second fluid motor such that said first and second fluid motors operate independently.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
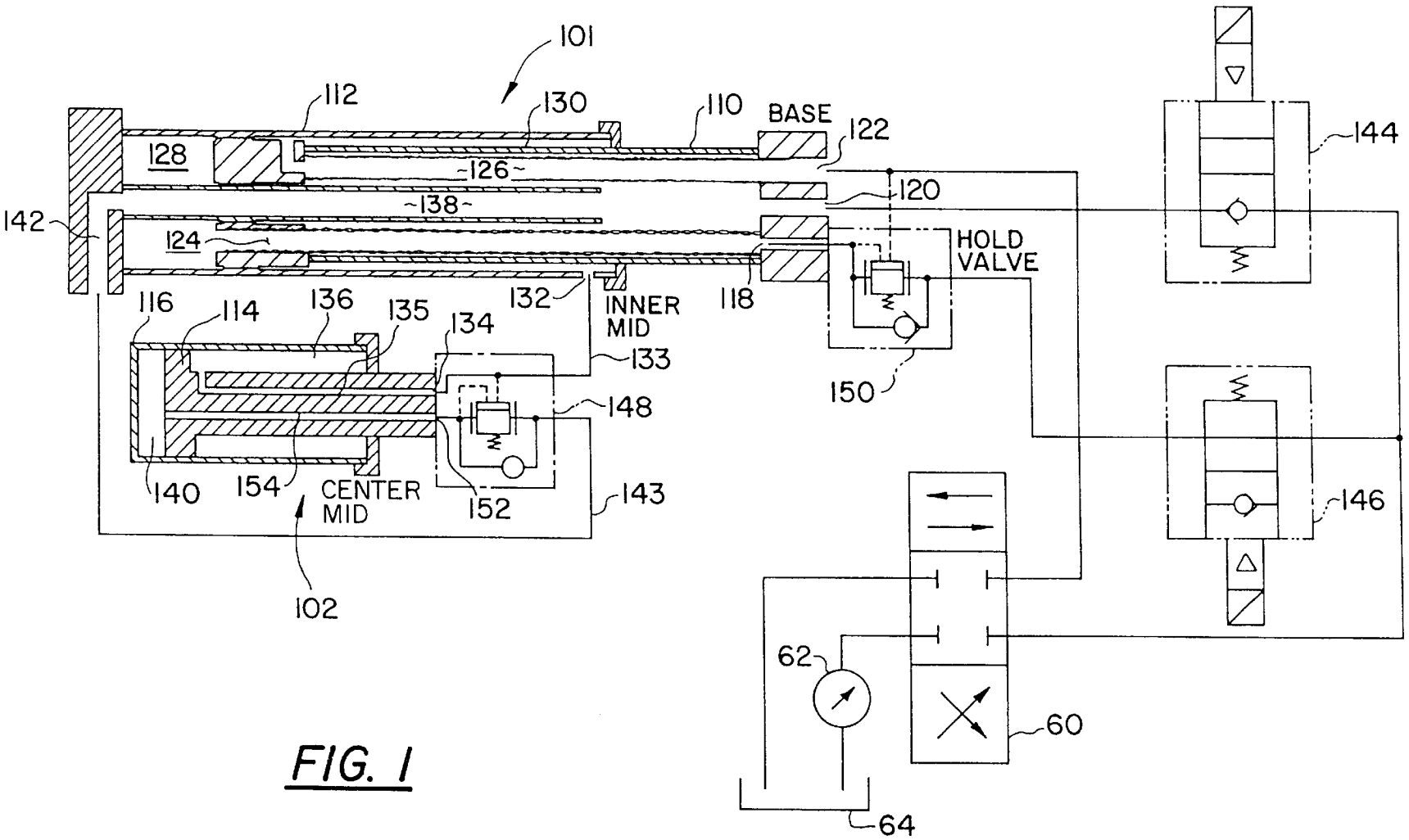
FIG. 1 illustrates a longitudinal cross-section of one embodiment of a telescoping system including multiple single-stage telescopic cylinders according to the present invention.

FIG. 1 illustrates a longitudinal cross-section of one embodiment of a telescoping system including multiple single-stage telescopic cylinders according to the present invention. As shown, the telescoping system includes a first tele cylinder 101 and a second tele cylinder 102. The first tele cylinder 101 includes a first piston 110 and a first cylinder 112. The second tele cylinder 102 includes a second piston 114 and a second cylinder 116.

Preferably, one end of the first piston 110 is mounted to the base section of a multi-section boom structure. A multi-section telescoping boom will be described as the multi-section telescoping structure for purposes of discussion. The multi-section boom structure can be a 3, 4, or 5 section boom. FIG. 1 illustrates the connections between the first and second tele cylinders 101 and 102 and a five section boom. Specifically, the first piston 110 is connected to the base section, the first cylinder 112 is connected to the inner mid section, and the second cylinder 116 is connected to the center mid section.

The first rod 110 has a first port 118, a second port 120, and a common port 122 formed in the rod end thereof. The rod and the piston head of the first rod 110 include a first passageway 124 formed therein such that hydraulic fluid entering the first rod 110 via the first port 118 communicates with a first chamber 128. The rod and the piston head of the first piston 110 also include a second passageway 126 which allows fluid communication between the common port 122 and a second chamber 130.

As shown in FIG. 1, the first cylinder 112 includes a single barrel cylindrical outer wall with a third passageway 132 to the second chamber 130 formed therein. Further, a cylindrical inner wall of the first cylinder 112 forms a trombone tube 138 extending through the piston head of the first piston 110 and into the rod of the first piston 110. The trombone tube 138 provides a passageway between the second port 120 and a fourth passageway 142 in the first cylinder 112.

The second piston 114 has a fourth port 134 and a fifth port 152 in one end thereof. A fifth passageway 135 in the second piston 114 provides fluid communication between the fourth port 134 and a third chamber 136, and a sixth passageway 154 in the second piston 114 provides fluid communication between the fifth port 152 and a fourth chamber 140. A first line 133 (e.g., a hose) connects the third passageway 132 to the fourth port 134. The third passageway 132, the first line 133, the fourth port 134 and the fifth passageway 135 allow fluid communication between the second chamber 130 and the third chamber 136.

A first holding valve 148 is disposed at the fifth port 152. The first holding valve 148 allows hydraulic fluid to freely flow into the fourth port 152, but does not allow hydraulic fluid to flow out unless hydraulic fluid is applied to a bias input thereof. A connection exists, as shown by dashed lines, between the first line 133 and the bias input of the first holding valve 148. The hydraulic fluid in the first line 133 can pilot the first holding valve 148 open to allow hydraulic fluid to flow out of the fifth port 152. A second line 143 connects the fourth passageway 142 with the first holding valve 148. Accordingly, the trombone tube 138, the fourth passageway 142, the second line 143, the first holding valve 148, the fifth port 152, and the sixth passageway 154 allow fluid communication between the second port 120 and the fourth chamber 140.

A second holding valve 150 is disposed at the first port 118. The second holding valve 148 allows hydraulic fluid to freely flow into the first port 118, but only allows hydraulic fluid to flow out of the first port 118 when hydraulic fluid is received at its bias input.

A first solenoid valve 144 regulates the supply of hydraulic fluid to the second port 120; and therefore, the first holding valve 148. The first solenoid valve 144 is closed in a de-energized state. A second solenoid valve 146 controls the supply of hydraulic fluid to the second holding valve 150, and is open in a de-energized state. Both the first and second solenoid valves 144 and 146 are connected to a first control port of a control valve 60. A second control port of the control valve 60 is connected to the common port 122 and the bias input of the second holding valve 150.

The control valve 60 is a tri-state control valve. In a first state, the hydraulic fluid supplied to the control valve 60 by a pump 62 is output from the first control port (i.e., to the first and second solenoid valves 144 and 146), while the hydraulic fluid at the second control port is exhausted to a reservoir 64. In a second state, no hydraulic fluid is supplied to or exhausted from either the first or second control ports. In the third state, the hydraulic fluid from the pump 62 is supplied to the second control port (i.e., the common port 122 and the bias input of the second holding valve 150), while the hydraulic fluid at the first control port is exhausted to the reservoir 64.

The operation of the telescoping system shown in FIG. 1 will now be described. The telescopic cylinder according to the present invention has two modes of operation: sequenced and synchronized.

Sequenced operation will be discussed first. Assuming that the telescopic cylinder illustrated in FIG. 1 is fully retracted, the first and second solenoid valves 144, 146 are de-energized, and the control valve 60 is placed in the first state. In the de-energized state, the first solenoid valve 144 is closed and the second solenoid valve 146 is open. Consequently, hydraulic fluid flows via the second solenoid valve 146 through the second holding valve 150 into the first port 118. The hydraulic fluid supplied to the first port 118 flows via the first passageway 124 into the first chamber 128, and exerts a force on the piston head of the second piston 114. As a result, the first cylinder 112 will extend.

Once fully stroked, the first solenoid valve 144 and the second solenoid valve 146 are energized. The fully stroked position can be detected by, for example, a proximity switch (not shown). Energizing the first and second solenoid valves 144 and 146 causes the first solenoid valve 144 to open and the second solenoid valve 146 to close. Hydraulic fluid then flows through the first solenoid valve 144 and enters the second port 120. The hydraulic fluid flowing into the second port 120 enters the fourth chamber 140 via the trombone tube 138, the fifth passageway 142, the line 143, the first holding valve 148, the fourth port 152, and the sixth passageway 154. This hydraulic fluid exerts pressure on the second cylinder 116 causing the second cylinder 116 to extend. Once fully stroked, the first solenoid valve 144 is de-energized. Again, the fully stroked position can be detected using a proximity switch (not shown).

To retract the telescopic cylinder illustrated in FIG. 1, the first solenoid valve 144 is opened, the second solenoid valve 146 is closed, and the control valve 60 is placed in the third state. Accordingly, hydraulic pressure is supplied to the common port 122 and the bias input of the second holding valve 150. The supply of hydraulic fluid pilots the second holding valve 150 open to allow hydraulic fluid to flow out of the first port 118.

The hydraulic fluid supplied to the common port 122 flows into the second chamber 130 via the second passageway 126. The force exerted upon the first cylinder 112 by the hydraulic fluid, however, does not cause the first cylinder 112 to retract since the second solenoid valve 146 is maintained in the closed state. Instead, the hydraulic fluid flows into the third chamber 136 via the third passageway 132, the line 133, and the fourth passageway 134. The hydraulic fluid flowing through the line 133 is supplied to the bias input of the first holding valve 148, and pilots the first holding valve 148 open. The hydraulic fluid in the third chamber 136 exerts a force on the second cylinder 116 causing the second cylinder 116 to retract since the first holding valve 148 and first solenoid valve 144 are open allowing hydraulic fluid to flow therethrough.

Once the second cylinder 116 has fully retracted, the first solenoid valve 144 is closed and the second solenoid valve 146 is opened. In this state, hydraulic fluid is allowed to flow through the second solenoid valve 146, such that the force exerted on the first cylinder 112 by the hydraulic fluid in the second chamber 130 causes the first cylinder 112 to retract.

In the synchronized mode of operation, the first and second solenoid valves 144 and 146 are switched between the open and closed states at predetermined positional settings to extend the first cylinder 112 and the second cylinder 116 in a synchronized manner. Likewise, once the hydraulic fluid has been supplied to the common port 122, the first and second solenoid valves 144 and 146 are also switched between the open and closed state in order to retract the first and second cylinders 112 and 116 in a synchronized manner.

In the telescoping system according to the present invention, the hydraulic connections are made such that no long hoses, which must extend and retract with the operation of the telescopic cylinder, are required, and the hose reels therefor are likewise eliminated.

The holding valve, solenoid valve and single control valve hydraulic control system in the telescoping system according to the present invention permits independent control over each single stage telescopic cylinder. Accordingly, the telescoping system provides great flexibility.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A telescoping system, comprising:

a first tele cylinder including a first cylinder, a first rod having a first and second end, a first piston head connected to said first end of said first rod and disposed in said first cylinder, said second end of said first rod including first, second and third ports;

said first rod, said first piston head and said first cylinder defining a first chamber;

said first cylinder and said first piston head defining a second chamber;

said first rod and said first piston head including a first passageway communicating said first port and said first chamber and a second passageway communicating said third port and said second chamber;

said first cylinder and said first rod including a third passageway communicating with said second port;

said first cylinder including a fourth passageway communicating with said first chamber;

a second tele cylinder, structurally separate from said first tele cylinder, including a second cylinder, a second rod having a third and fourth end, a second piston head connected to said third end of said second rod and disposed in said second cylinder, said fourth end of said second rod including a fourth and fifth port;

a first line connecting said fourth port and said third passageway;

a second line connecting said fifth port and said fourth passageway;

said second rod, said second piston head and said second cylinder defining a third chamber;

said second cylinder and said second piston head defining a fourth chamber;

said second rod including a fifth passageway communicating said third chamber and said fifth port; and said second rod and said second piston head including a sixth passageway communicating said fourth port and said fourth chamber.

2. The telescoping system of claim 1, further comprising:

a first holding valve connected between said first line and said fourth port and having a first bias input, said first holding valve allowing hydraulic fluid to freely enter said fourth port, and allowing hydraulic fluid to exit said fourth port when hydraulic fluid is received at said first bias input.

3. The telescoping system of claim 2, further comprising:

a second holding valve connected to said third port and said third passageway, and having a second bias input, said second holding valve allowing hydraulic fluid to freely enter said third port, and allowing hydraulic fluid to exit said third port when hydraulic fluid is received at said second bias input.

4. The telescoping system of claim 3, wherein said first bias input connected to said second line; and said second bias input is in fluid communication with said first port.

5. The telescoping system of claim 1, further comprising:

supply means for supplying said hydraulic fluid to said first and second tele cylinders such that said first and second tele cylinders extend and retract independently.

6. The telescoping system of claim 5, wherein said supply means comprises:

a first holding valve connected between said first line and said fourth port and having a first bias input, said first holding valve allowing hydraulic fluid to freely enter said fourth port, and allowing hydraulic fluid to exit said fourth port when hydraulic fluid is received at said first bias input, said first bias input connected to said second line;

a second holding valve connected to said third port and having a second bias input, said second holding valve allowing hydraulic fluid to freely enter said third port, and allowing hydraulic fluid to exit said third port when hydraulic fluid is received at said second bias input;

a first solenoid valve selectively supplying hydraulic fluid to said first holding valve;

a second solenoid valve selectively supplying hydraulic fluid to said second port;

a third line connected to said first port and said second bias input; and a control valve selectively supplying hydraulic fluid to and exhausting hydraulic fluid from said third line, said first solenoid valve, and said second solenoid valve.

7. The telescoping system according to claim 6, wherein said control valve includes a first and second control port, said first port connected to said third line and said second port connected to said first and second solenoid valves, and said control valve selectively supplying hydraulic fluid to and exhausting hydraulic fluid from said first and second control ports.

8. A telescoping system, comprising:

a first fluid motor having a first extension chamber and a first retraction chamber;

a second fluid motor, structurally separate from said first fluid motor, having a second extension chamber and a second retraction chamber;

means for providing fluid communication between said first fluid motor and said second fluid motor; and wherein said first fluid motor includes a first extension supply port in fluid communication with said first extension chamber, a second extension port in fluid communication with said second extension chamber via said providing means, and a retraction supply port in fluid communication with said first retraction chamber and in fluid communication with said second retraction chamber via said providing means.

9. The telescoping system according to claim 8, wherein said providing means controls supply of hydraulic fluid to said second extension and retraction chambers.

10. The telescoping system of claim 9, wherein said providing means comprises:

a line connecting said first retraction chamber and said second retraction chamber; and a holding valve in fluid communication with said second extension chamber and said first fluid motor, said holding valve having a bias input, said holding valve allowing hydraulic fluid to freely enter said second extension chamber, and allowing hydraulic fluid to exit said second extension chamber when hydraulic fluid is received at said bias input, said bias input connected to said line.

11. A telescoping system, comprising:

a first fluid motor having a first extension chamber and a first retraction chamber;

a second fluid motor, structurally separate from said first fluid motor, having a second extension chamber and a second retraction chamber;

a hydraulic fluid supply system controlling supply of hydraulic fluid to said first fluid motor and between said first fluid motor and said second fluid motor such that said first and second fluid motors operate independently.

12. The telescoping system of claim 11, wherein said hydraulic fluid supply system comprises:

a first line in fluid communication with said first retraction chamber;

a first holding valve in fluid communication with said first extension chamber and having a first bias input, said first holding valve allowing hydraulic fluid to freely enter said first extension chamber, and allowing hydraulic fluid to exit said first extension chamber when hydraulic fluid is received at said first bias input, said first bias input connected to said first line;

a second line connecting said first retraction chamber and said second retraction chamber;

a second holding valve in fluid communication with said second extension chamber and said first fluid motor, and having a second bias input, said second holding valve allowing hydraulic fluid to freely enter said second extension chamber, and allowing hydraulic fluid to exit said second extension chamber when hydraulic fluid is received at said second bias input, said second bias input connected to said second line;

a first solenoid valve selectively supplying hydraulic fluid to said first holding valve;

a second solenoid valve selectively supplying hydraulic fluid to said second holding valve via said first fluid motor; and a control valve selectively supplying hydraulic fluid to and exhausting hydraulic fluid from said first line, said first solenoid valve, and said second solenoid valve.

13. The telescoping system according to claim 12, wherein said control valve includes a first and second control port, said first line connected to said first control port and said second control port connected to said first and second solenoid valves, and said control valve selectively supplying hydraulic fluid to and exhausting hydraulic fluid from said first and second control ports.

14. The telescoping system of claim 11, wherein said hydraulic fluid supply system comprises:

a valve system controlling supply of hydraulic fluid to only said first fluid motor; and a valve and conduit arrangement providing and controlling fluid communication between said first and second fluid motors.

* * * * *